US008062143B1

(12) United States Patent
Meersman

(10) Patent No.: US 8,062,143 B1
(45) Date of Patent: Nov. 22, 2011

(54) GOLF COURSE SAND BUNKER CONSTRUCTION AND ITS ASSOCIATED METHOD OF PRODUCTION

(76) Inventor: Daniel Meersman, Fort Washington, PA (US)

( * ) Notice: Subject to any disclaimer, the term of this patent is extended or adjusted under 35 U.S.C. 154(b) by 84 days.

(21) Appl. No.: 12/562,130

(22) Filed: Sep. 17, 2009

(51) Int. Cl.
*A63B 57/00* (2006.01)

(52) U.S. Cl. ..... 473/173; 405/302.4

(58) Field of Classification Search ..... 473/168, 473/169, 173; 405/302.4–302.7
See application file for complete search history.

(56) References Cited

U.S. PATENT DOCUMENTS

| | | | | |
|---|---|---|---|---|
| 4,535,989 | A * | 8/1985 | Lovin | 473/158 |
| 4,960,345 | A * | 10/1990 | Hurley et al. | 405/38 |
| 5,147,156 | A * | 9/1992 | Guettler et al. | 406/197 |
| 5,746,546 | A * | 5/1998 | Hubbs et al. | 405/263 |
| 5,803,820 | A * | 9/1998 | McCarty | 473/173 |
| 6,467,991 | B1 * | 10/2002 | Joyce et al. | 404/76 |
| 6,863,477 | B2 | 3/2005 | Jenkins et al. | |
| 7,114,877 | B2 * | 10/2006 | Wilkerson | 405/43 |
| 7,207,747 | B1 * | 4/2007 | England | 405/43 |
| 7,241,227 | B2 * | 7/2007 | Campbell | 473/170 |
| 7,344,340 | B2 * | 3/2008 | Carlson et al. | 405/302.6 |
| 7,399,145 | B2 * | 7/2008 | Clark | 405/302.7 |
| 7,413,380 | B2 * | 8/2008 | Corwon et al. | 405/37 |
| 7,699,562 | B2 * | 4/2010 | Clark | 405/129.75 |
| 2003/0118403 | A1 * | 6/2003 | Wilkerson | 405/36 |
| 2003/0177799 | A1 * | 9/2003 | Park et al. | 71/903 |
| 2004/0156679 | A1 * | 8/2004 | Jenkins et al. | 404/76 |
| 2007/0237583 | A1 * | 10/2007 | Corwon et al. | 405/37 |
| 2007/0278142 | A1 * | 12/2007 | Clark | 210/153 |

* cited by examiner

*Primary Examiner* — Mark Graham
(74) *Attorney, Agent, or Firm* — LaMorte & Associates

(57) ABSTRACT

A sand bunker construction having different porous layers that are built up upon the ground and internal drainage. The first layer is a layer of aggregate. The aggregate is gravel having an aggregate size large enough to avoid displacement from rain and irrigation spray. A porous matrix is placed upon the first layer. The porous matrix is made from gravel aggregate that is coated with a binding agent, such as asphalt, tar, or cement. The binding agent is added in amounts only sufficient to bind the aggregate. The result is a porous matrix having numerous voids between the various pieces of aggregate. A covering of sand is applied over the porous matrix. The sand fills the top voids in the porous matrix and buries the porous matrix. Due to the rough texture and porosity of the porous matrix, the porous matrix holds the sand in place and greatly inhibits erosion.

16 Claims, 3 Drawing Sheets

GOLF COURSE SAND BUNKER CONSTRUCTION AND ITS ASSOCIATED METHOD OF PRODUCTION

BACKGROUND OF THE INVENTION

1. Field of the Invention

In general, the present invention relates to the construction of sand bunkers on golf courses. More particularly, the present invention relates to systems and methods used to reduce the adverse effects of sand erosion and soil contamination caused by water within the confines of a sand bunker.

2. Prior Art Description

Golf has been played since at least the $12^{th}$ century. During this period of time, the game has evolved in many ways. Not only have the clubs and balls changed, but the actual structure of golf courses has also changed.

It is only in the past one hundred and fifty years that golf courses have been designed to contain artificial hazards. Before this, golf courses were created in parks and other natural settings. The hazards were the trees, hills, ponds, and streams that naturally occurred across the course. In modern golf courses, most every hole is designed with a series of artificial hazards. The hazards include water traps, planted tree lines, hills, and sand bunkers.

Sand bunkers, often called sand traps, are one of the most predominant hazards on a modern golf course. Sand traps are widely used because they are both easy and inexpensive to build. Traditionally, in order to build a sand bunker, a hole is dug into the earth, often on the side of a hill. The hole is then filled with sand. The sand bunkers are placed in strategic positions on a golf course in areas that unskilled golfers are likely to place shots.

Although sand bunkers are easy to build, they have proven to be expensive and hard to maintain. Sand bunkers are exposed to both rain and the spray of irrigation systems. This flow of water tends to wash the sand in a sand bunker to the lowest point in the sand bunker. The groundskeeper of the golf course must therefore periodically respread the sand in every sand bunker, especially after a heavy rain.

If a sand bunker is built without a lining, sand tends to easily wash off of the face of the bunker during rainfall events and wash to the bottom of the bunker. In addition weeds and grass quickly begin to grow through the sand. Furthermore, mud from below and around the sand bunker mixes in with the loose sand to contaminate the bunker sand and reduce the bunker's playing quality. As such, the sand in the sand trap must be periodically removed and replaced following contamination and washout events, or shoveled from the bottom of the bunker and thrown back onto the side slopes. Today, many sand bunkers are lined. In some instances, sand bunkers are lined with a water impermeable barrier or the bottom of the sand bunker is spray-coated with such a barrier. Such a lining system both prevents the growth of weeds and prevents mud from intermixing with the sand. Such liners are exemplified by U.S. Pat. No. 6,467,991 to Joyce, entitled Process And material For Preventing Contamination And Erosion Of Golf Course Sand Traps.

The problem with nearly all lining methods is they must be adhered to the underlying soil in some fashion. This has proven problematic as historic adhering methods such as sod staples or industrial glues routinely fail and cannot withstand the challenges of manual or mechanical rakes catching the material and pulling them to the surface, freeze thaw conditions pushing them out of the ground, or water backing into drainage pipes and into the bunker floor during heavy rain periods and pushing the liners closer to the sand surface making them easier to get snagged by rakes.

Another problem with water impermeable liners or semi-impermeable liners is that they retain water and/or drain water very slowly. Sand bunkers tend to be depressions. As such, water from rain and sprinklers tend to flow into sand bunkers. If the water puddles within the sand bunker, much of the sand becomes submersed. The sand will then quickly erode to the lowest point of the sand bunker, leaving the side of the sand bunker bear and devoid of sand.

Water impervious liners have also been used in combination with drains to prevent water accumulation. In such systems, the water impervious liners direct water into a subterranean drain. Such a prior art system is shown in U.S. Pat. No. 7,399,145 to Clark, entitled Multi-Layer Liner Assembly For A Sand Trap. However, not all sand bunkers have discernable low points in which drains can be placed. The result is areas in the sand bunker that drain well and other areas that puddle.

A more popular lining system for sand bunkers involves the use of a water permeable fabric liner. The fabric liner allows water drainage at all points. It also hinders weed growth. Liners with fiber napping, much like carpeting, have also been developed to help prevent the sand from eroding. Such prior art liners are exemplified by U.S. Pat. No. 6,863,477 to Jenkins, entitled, Method And Material For Preventing Erosion And Maintaining Playability Of Golf Course Sand Bunkers.

A problem associated with fabric liners is that they tend to degrade over time. Fabric liners are often pierced and snagged by the rakes used to groom a sand bunker. If a section of a fabric liner gets pulled to the surface of a sand bunker by a rake or a golf club, then that section of the fabric liner must be cut away. This leaves a large hole in the liner. Furthermore, water tends to flow under sheet liners, thereby eroding the earth under the liner and contaminating the sand. Without the support of the underlying earth, fabric liners often rip in the unsupported areas. This thin, fabric layer of material also leaves little distance between the underlying soil and the sand layer, thus soil contamination of the desired sand occurs at an accelerated pace over time. Additionally, fabric liners can be gnawed upon by mice, voles, moles, groundhogs, and a variety of other subterranean animals, thereby causing even more holes in the liner. Consequently, the life of a fabric liner is short, requiring sand traps to undergo expensive restoration every few years.

A need therefore exists for a sand bunker configuration that is water permeable in all areas, inhibits sand erosion, reduces contamination, is low cost, and is much less susceptible to damage from rakes, clubs, heavy rainfall, freeze thaw conditions, or animals. This need is met by the present invention as described and claimed below.

SUMMARY OF THE INVENTION

The present invention is a sand bunker construction and the associated method of fabricating such a sand bunker construction. The sand bunker is comprised of different layers that are built up upon the ground and surrounding the interior drainage at the bottom of the sand bunker. It is recommended that some form of interior drainage is installed in the subgrade of the bunker floor. The first layer placed upon the ground is a layer of loose stone aggregate. The aggregate is gravel having an aggregate size large enough to avoid displacement from rain and irrigation spray. A porous matrix is placed upon the first layer. The porous matrix is made from gravel aggregate that is coated with a binding agent, such as asphalt, tar, or cement. The binding agent is added in amounts only sufficient to bind the aggregate. The result is a porous matrix having numerous voids between the various pieces of aggregate.

The porous matrix is spread across the entire sand bunker on top of the aggregate layer, including the contoured sides of the sand bunker. The porous matrix is permitted to cure in place within the bunker, therein reinforcing all surfaces of the sand bunker. Lastly, a covering of sand is applied over the porous matrix. The sand fills the voids in the porous matrix and buries the porous matrix. Due to the rough texture and porosity of the porous matrix, the porous matrix holds the sand in place and greatly inhibits the erosion of sand caused by rain, wind, and irrigation.

The resulting sand bunker construction is highly durable, and impervious to damage from animals, golf clubs, manual or mechanical rakes, and golf carts. The sand bunker construction, therefore, requires less maintenance than other sand bunker constructions and saves money be reducing labor costs and time spent maintaining bunkers following rain events.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention construction can be used to create a porous cart path, porous parking lot, sand garden, an animal habitat, or other confined region of sand, the embodiment illustrated shows the present invention configured as a sand bunker on a golf course. This embodiment is selected in order to set forth the best mode contemplated for the invention. The illustrated embodiment, however, is merely exemplary and should not be considered a limitation when interpreting the scope of the appended claims. Furthermore, variation of aggregate sizes and depths described will depend upon local or regional availability of materials, varying performance goals of a designer, acceptable or prohibitive cost of materials and construction, and varying weather conditions in different geographic location which may dictate less or more stringent construction methods.

Figure 1:
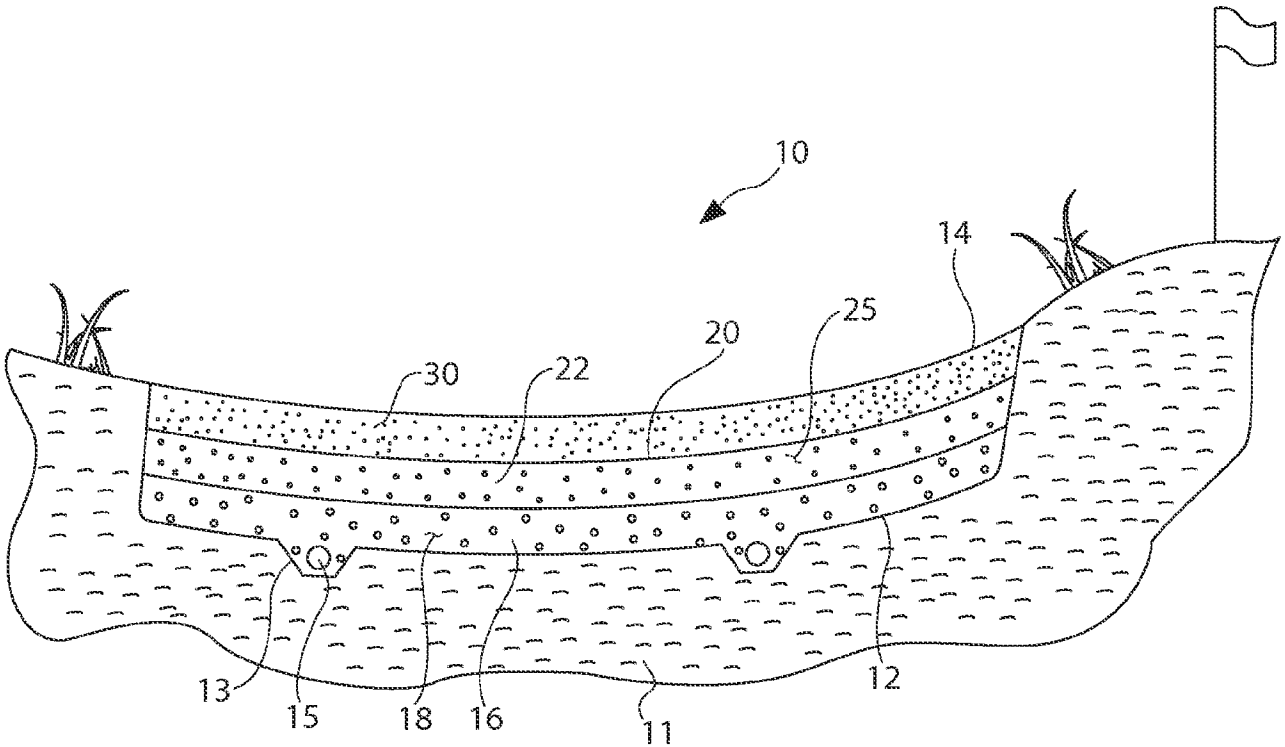
FIG. 1 is a broad cross sectional view of an exemplary embodiment of a sand bunker construction.
Figure 2:
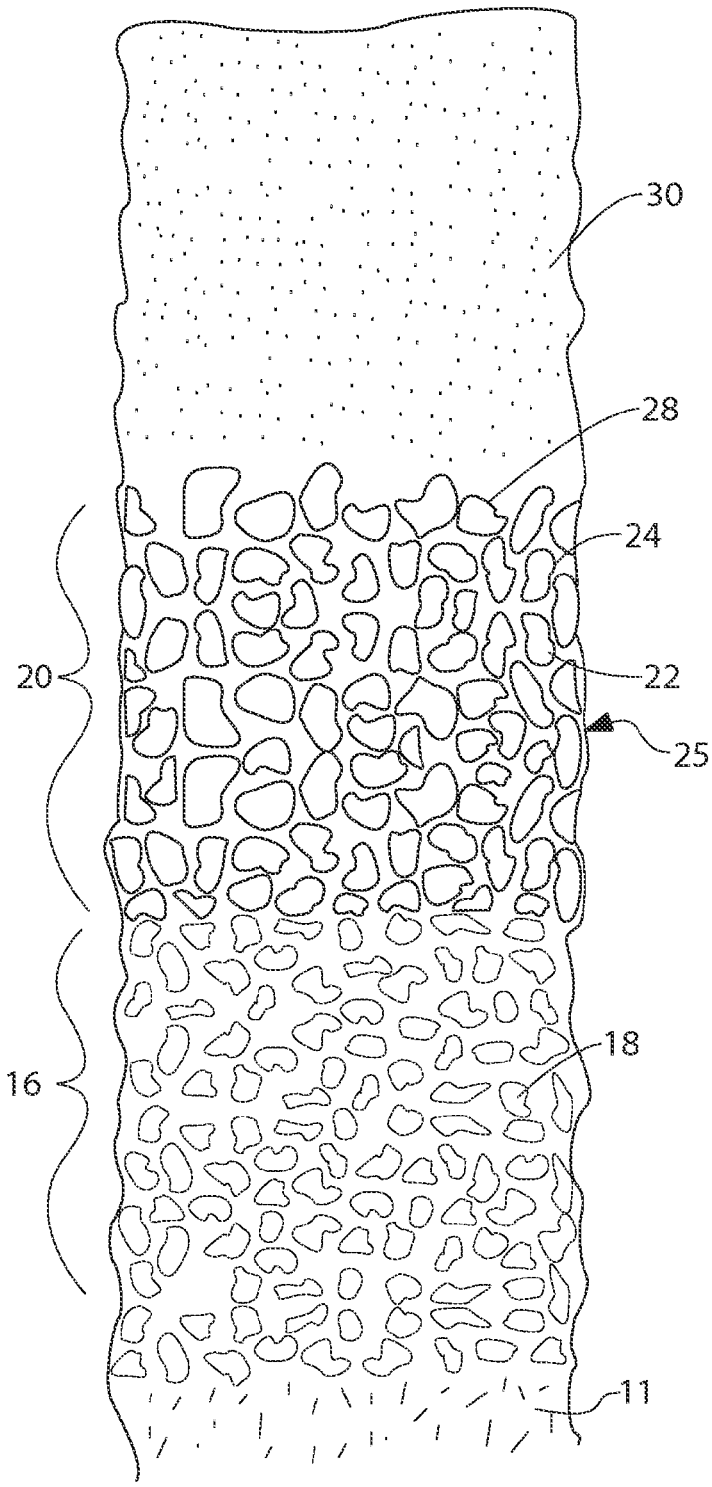
FIG. 2 is an enlarged cross section of a segment of the sand bunker construction from FIG. 1.

Referring to FIG. 1 and FIG. 2, there is shown a sand bunker construction 10 in accordance with the present invention. A sand bunker depression 12 is created in a golf course at the location and according to the dimensions of the golf course designer. The bottom of the sand bunker depression 12 is the earth 11 that naturally occurs at that location. The sand bunker depression 12 is created with the contoured surfaces 14 set forth by the golf course designer.

If the earth under a sand bunker construction 10 has good water drainage characteristics due to rock or sandy soil, then drains need not be installed under the sand bunker construction 10. However, in many instances, natural water drainage characteristics are below what is needed. In such a situation, channels 13 are formed in the earth 11 under the sand bunker construction. Drain conduit 15 is placed into the channels 13. The drain channel direct water away from the sand trap construction 10.

A first layer 16 of aggregate 18 is spread over the earth 11 in the sand bunker depression 12. The aggregate 18 fills the channels 13 and builds up upon the earth 11. The first layer 16 of aggregate 18 is gravel in the form of crushed stone. It is recommended that the first layer 16 of aggregate 18 be screened, but is not always necessary. However, it is preferred that the first layer 16 of aggregate 18 have an average aggregate size of between 1.8 millimeters and 50 millimeters, so that the aggregate 18 is large enough to resist displacement of sand from water erosion.

The first layer 16 of aggregate 18 is spread around any interior drainage and relatively evenly over the entire sand trap depression 12. The thickness of the first layer 16 of aggregate 18 is preferably between 2.5 centimeters and 16 centimeters. The thickness of the first layer 16 of aggregate 18 extends to the edges of the sand trap depression 12 so none of the aggregate 18 is visible along such edges.

A second layer 20 is applied over the first layer 16. The second layer 20 is a mixture that creates a porous matrix 25 of an aggregate 22 and a bonding agent 24. The second layer 20 preferably utilizes graded stone aggregate having an average size of between 1.8 millimeters and 50 millimeters. The aggregate 22 is lightly coated in a bonding agent 24 that cures in air. The bonding agent 24 preferably is asphalt, or asphalt tar. However, other usable bonding agents include cement and polymer adhesives, such as polyurethane. The bonding agent 24 is mixed with the aggregate 22 only in a volume sufficient enough to lightly coat the aggregate 22. This enables the aggregate 22 to clump together in the manner of caramel popcorn. However, the volume of the binding agent 24 is insufficient to fill the voids 26 that exist between the pieces of aggregate 22 in the second layer 20. As a result, the second layer 20 is highly porous, yet the individual pieces of aggregate 22 are bound together.

The second layer 20 is deposited atop the first layer 16 before the bonding agent 24 cures. Accordingly, the second layer 20 adheres and bonds to the aggregate 18 at the top of the first layer 16. The second layer 20 is lightly to moderately rough and clumpy by nature. The second layer 20 is dumped into the sand bunker and is manually spread atop the first layer 16. Depending on site conditions and the specific material being used, the second layer 20 may or may not be subjected to a roller or any powered tamping machine. Regardless, the top surface 28 of the second layer 20 is maintained rough and clumpy. This maintains the open voids 26 in the second layer 20.

The second layer 20 is spread relatively evenly over the entire first layer 16 of aggregate 18. The thickness of the second layer 20 should be no less than three times the nominal maximum value for the aggregate in the second layer, and is preferably between 2.5 centimeters and 16 centimeters. The thickness of the second layer 16 of aggregate 20 extends toward the edges of the sand trap depression 12 so that none of the second layer 20 is visible along the side of the sand bunker construction 10.

The second layer 20 is permitted to air cure. Depending upon the bonding agent 24 used and ambient conditions, curing occurs within one to twenty-four hours. Once the second layer 20 cures, sand 30 is deposited over the second layer 20. The sand 30 is deposited to a depth of at least seven centimeter. The sand 30 falls into the various voids 26 of the second layer 20. Although cured, the bonding agent 24 may be tacky, especially if asphalt tar is used. Some of the sand 30 may stick to the bonding agent 24.

The rough texture and deep porosity of the second layer 20 is highly effective in preventing erosion in the top layer of sand 30. Should the top layer of sand 30 ever become exposed to rain water or sprinkler water, the water permeates through the sand 30, through the second layer 20, through the first layer 16 and into the bunker's interior drainage and earth 11 below. Any erosion that does occur will slowly cause the sand 30 to fall toward the lowest points in the sand trap construction 10. During maintenance periods, the sand 30 need only be shoveled from the low points of the sand trap construction 10 and tossed onto the high points of the contoured surfaces 14. The sand 30 will be fairly well retained in the high points by the very rough and porous top surface 28 of the underlying second layer 20 and the ample porosity of all layers. It should be noted it will take much more rainfall for sand displacement to occur with this layering method than with traditional liner methods.

The second layer 20 cannot easily be damaged by a rake or by a golf club. Accordingly, the second layer 20 can last for longer periods of time without damage caused by normal use and maintenance of the golf course. Furthermore, both the second layer 20 and the underlying first layer 16 are less affected by subterranean animals, freezing and thawing conditions, heavy traffic, and rot.

Figure 3:
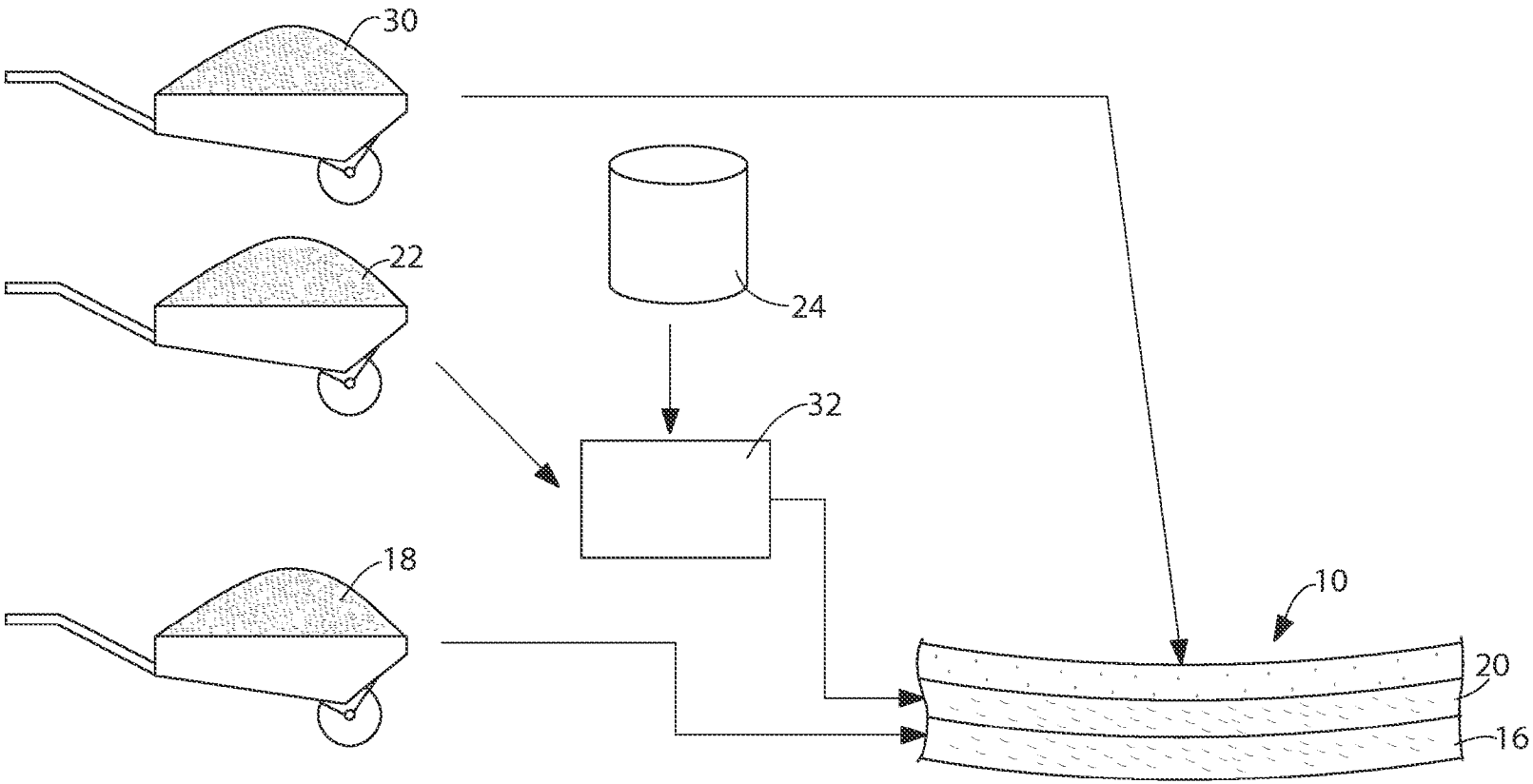
FIG. 3 is a schematic illustrating a method of constructing the sand bunker of FIGS. 1 and 2.

Referring now to FIG. 3, the method of creating the sand trap construction 10 is described in more detail. To create the sand trap construction 10, aggregate 18, 22, sand 30 and a bonding agent 24 are brought to the site of a sand trap depression 12. The aggregate 18, 22 is crushed stone and is very inexpensive. Furthermore, such aggregate 18, 22 is locally or regionally available near most any golf course in the United States. Likewise, sand 30 is inexpensive and locally or regionally available. The bonding agent 24, especially if asphalt tar, is also inexpensive and locally or regionally available. Accordingly, all the components needed to create the sand bunker construction 10 can be obtained at low cost from local or regional sources. No great expense is, therefore, required to ship and store the required construction materials.

Once the sand 30, aggregate 18, 22 and binding agent 24 are brought to a sand trap depression 12, some aggregate 18 is spread as the first layer 16. The second layer 20 aggregate is usually premixed with the bonding agent prior to delivery such as asphalt in aggregate, but could also be prepared by mixing the aggregate 18 with the binding agent 24 in a mixer 32. If the bonding agent 24 is cement, the mixing can be accomplished using a standard concrete mixer. If the bonding agent 24 is asphalt tar, the mixing can be accomplished in a standard heated asphalt mixer.

Once mixed, the second layer 20 is dumped into the bunker and applied over the first layer 16 using shovels, rakes, and or trowels. If the grade of the sand trap depression 12 is particularly steep, the second layer 20 can be made particularly rough by chopping into the second layer 20 with a shovel edge.

Once the second layer 20 is properly formed over the first layer 16, the bonding agent 24 is allowed to cure, or at least mostly cure, in the open air. This locks the configuration of the second layer 20 in place. Sand 30 is then dumped into the bunker and shoveled over the second layer 20 and is raked into a finished condition. As has been previously mentioned, the sand may cling to the second layer 20.

It will be understood that the embodiment of the present invention that is illustrated and described is merely exemplary and that a person skilled in the art can make many variations to those embodiments. For instance, the crushed stone aggregate described can be replaced with other aggregate, such as recycled crushed concrete. Likewise, the thickness of the various layers can be altered to meet: the contouring requirements of oddly formed sand trap depressions, varying performance goals of the person constructing the bunker, acceptable or prohibitive cost of materials and construction, varying historic weather conditions and annual rainfall totals in different geographic locations which dictate less or more stringent construction methods. Variations of this method will likely be customized to each golf course and customers needs and goals.

In addition depending on environment conditions of different geographic regions, there may be instances where there is no need for the first layer of aggregate. All such embodiments are intended to be included within the scope of the present invention as defined by the claims.

What is claimed is:

1. A method of constructing a sand bunker in a golf course, comprising the steps of:

providing stone aggregate;

providing a binding agent for said stone aggregate;

providing sand;

creating a first layer with some of said stone aggregate;

mixing some of said stone aggregate with said binding agent to form a porous matrix;

creating a second layer of said porous mixture over said first layer;

covering said second layer with said sand.

2. The method according to claim 1, wherein said step of providing a binding agent includes providing a binding agent selected from asphalt and asphalt tar.

3. The method according to claim 1, wherein said step of providing a binding agent includes providing a binding agent of cement.

4. The method according to claim 1, wherein said step of providing stone aggregate includes providing crushed stone having an average aggregate size of between 1.8 millimeters and fifty millimeters.

5. The method according to claim 1, wherein said step of creating a first layer includes depositing said crushed stone in a layer between 2.5 and sixteen centimeters thick.

6. The method according to claim 1, wherein said step of creating a second layer of said porous mixture includes creating a second layer between 2.5 and sixteen centimeters thick.

7. A method of constructing a sand bunker construction, comprising the steps of:

digging a sand bunker depression to a base layer of earth;

laying a first layer of loose aggregate upon said base layer;

laying a second layer, comprised of aggregate coated in a bonding agent, upon said first layer, wherein said aggregate in said second layer is bonded together in a porous matrix by said bonding agent; and laying a layer of sand upon said second layer.

8. The method according to claim 7, wherein said bonding agent is asphalt tar.

9. The method according to claim 7, wherein said bonding agent is cement.

10. The method of claim 7, wherein said first layer of aggregate contains crushed stone having an average aggregate size of between 1.8 millimeters and 50 millimeters.

11. The method of claim 7, wherein said second layer contains crushed stone having an average aggregate size of between 1.8 millimeters and 50 millimeters.

12. The method of claim 7, wherein said first layer has an average thickness of between 2.5 centimeters and sixteen centimeters.

13. The method of claim 7, wherein said second layer has an average thickness of between 2.5 centimeters and sixteen centimeters.

14. A method of constructing a sand bunker, comprising the steps of:

emptying a sand trap bunker to a base layer;

providing a loose layer of crushed stone atop said base layer;

applying a porous matrix layer of gravel aggregate mixed with a binding agent over said loose layer of crushed stone, said porous matrix having a top surface and open voids in said top surface, and covering said top surface of said porous matrix layer with a layer of sand.

15. The method according to claim 14, wherein said binding agent is asphalt tar.

16. The method according to claim 14, wherein said binding agent is cement.

* * * * *